US005276229A

United States Patent [19]

Buchanan et al.

[11] Patent Number: 5,276,229

[45] Date of Patent: * Jan. 4, 1994

[54] HIGH VI SYNTHETIC LUBRICANTS FROM THERMALLY CRACKED SLACK WAX

[75] Inventors: J. Scott Buchanan, Mercerville; Margaret M. Wu, Skillman, both of N.J.

[73] Assignee: Mobil Oil Corp., Fairfax, Va.

[ * ] Notice: The portion of the term of this patent subsequent to Aug. 4, 2009 has been disclaimed.

[21] Appl. No.: 903,392

[22] Filed: Jun. 24, 1992

Related U.S. Application Data

[63] Continuation-in-part of Ser. No. 571,345, Aug. 23, 1990, Pat. No. 5,146,022.

[51] Int. Cl.[5] ..... C07C 2/74; C07C 2/02

[52] U.S. Cl. ..... 585/255; 585/530; 585/532; 208/106

[58] Field of Search ..... 585/530, 532, 255; 208/106

[56] References Cited

U.S. PATENT DOCUMENTS

| | | | |
|---|---|---|---|
| 2,642,466 | 6/1953 | Garner et al. | 208/72 |
| 2,945,076 | 7/1960 | Pardee | 585/648 |
| 3,103,485 | 9/1963 | Cahn | 208/130 |
| 3,705,926 | 12/1972 | Rumpf et al. | 585/648 |
| 4,042,488 | 8/1977 | Peraful | 208/102 |
| 4,395,578 | 7/1983 | Larkin | 585/10 |
| 4,420,646 | 12/1983 | Darden et al. | 585/10 |
| 4,827,073 | 5/1989 | Wu | 585/530 |
| 4,837,064 | 5/1989 | Wu | 585/530 |
| 4,996,384 | 2/1991 | Pelrine et al. | 585/530 |
| 5,136,118 | 8/1992 | Buchanan et al. | 585/255 |
| 5,146,022 | 9/1992 | Buchanan et al. | 585/10 |

FOREIGN PATENT DOCUMENTS

| | | |
|---|---|---|
| 1323353 | 7/1973 | United Kingdom . |

*Primary Examiner*—Patrick P. Garvin
*Assistant Examiner*—E. D. Irzinski
*Attorney, Agent, or Firm*—Alexander J. McKillop; Malcolm D. Keen

[57] ABSTRACT

A process for the production of synthetic lubricants having high viscosity index by oligomerizing a mixture of alpha-olefins produced from the thermal cracking of slack wax or recycled slack wax. The oligomerization is carried out with a reduced metal oxide catalyst, preferably a carbon monoxide reduced chromium oxide on a silica support. The olefin product from the thermal cracking step is purified, preferably by hydrotreating prior to the oligomerization step.

24 Claims, No Drawings

HIGH VI SYNTHETIC LUBRICANTS FROM THERMALLY CRACKED SLACK WAX

CROSS REFERENCE TO RELATED APPLICATIONS

This application is a continuation-in part of our earlier application Ser. No. 07/571,345, filed Aug. 23, 1990, and now U.S. Pat. No. 5,146,022.

FIELD OF THE INVENTION

This invention relates to a process for the production of synthetic lubricants from thermally cracked slack wax. In particular, the invention relates to the production of high viscosity index (VI) synthetic lubricants by the oligomerization of the olefinic reaction product obtained by thermally cracking slack wax.

BACKGROUND OF THE INVENTION

Current trends in the design of automotive engines are associated with higher operating temperatures as the efficiency of the engines increases and these higher operating temperatures require successively higher quality lubricants. One of the requirements is for higher viscosity indices (V.I.) in order to reduce the effects of the higher operating temperatures on the viscosity of the engine lubricants. High V.I. values have conventionally been attained by the use of V.I. improvers such as polyacrylates, but there is a limit to the degree of improvement which may be effected in this way. In addition, V.I. improvers tend to undergo degradation under the effects of high temperatures and high shear rates encountered in the engine, the more stressing conditions encountered in high efficiency engines result in even faster degradation of oils which employ significant amounts of V.I. improvers. Thus, there is a continuing need for automotive lubricants which are based on fluids of high viscosity index and which are stable to the high temperature, high shear rate conditions encountered in modern engines.

Synthetic lubricants produced by the polymerization of alpha olefins in the presence of certain catalysts have been shown to possess excellent V.I. values. Oligomers of 1-alkenes from $C_6$ to $C_{20}$, especially 1-decene, have been converted to commercially useful synthetic lubricants by oligomerization with Lewis acid catalysts such as boron trifluoride. Examples of such processes are described, for example, in U.S. Pat. No. 4,395,578 which describes the oligomerization of alpha-olefins using boron trifluoride catalyst; the alpha-olefins are produced by ethylene polymerization or wax pyrolysis. Viscosity indices up to 112 are said to be achieved. Similarly, U.S. Pat. No. 4,420,646 describes a process for the production of synthetic lubricants by the oligomerization of alpha-olefins produced from wax pyrolysis. Boron trifluoride catalyst providing viscosity indices of about 130 are reported.

These synthetic products are, however, expensive to produce by conventional synthetic procedures and usually require expensive starting materials. There is therefore a need for the production of high V.I. lubricants from mineral oil stocks which may be produced by techniques comparable to those presently employed in petroleum refineries.

In prior application Ser. No. 07/571,345, we have described a process for making synthetic lubricants of high viscosity index from slack wax by a process of thermal cracking followed by oligomerization in the presence of an aluminum trichloride catalyst. The use of the cheap slack wax feed is notable in giving oligomerization products which result in a higher product VI and viscosity; the use of the aluminum trichloride catalyst also results in a higher yield with the wax-derived olefins.

Another approach to the production of high quality synthetic lubricants is described in U.S. Pat. Nos. 4,827,064 and 4,827,073. These patents describe the production of synthetic lubricants from alpha-olefins such as 1-decene wiuth catalysts made up of an oxide of a metal of Group VI of the Periodic Table in a reduced valence state, preferably a chromium catalyst produced by the reduction in carbon monoxide of a silica-supported chromium oxide. The olefin oligomers produced in this way exhibit extraordinarily high VI values, typically as high as about 200. The process is also favorable in that it uses a heterogeneous catalyst which can be used in a simple fixed-bed operation, permitting ready separation of the oligomerization products; the catalyst may also be readily regenerated by an oxidation-reduction process, as described in U.S. Pat. No. 4,996,384. Reference is made to U.S. Pat. Nos. 4,827,064; 4,827,073 and 4,996,384 for a descrition of the reduced metal oxide catalysts used in the production of the HVI-PAO synthetic lubricants, as well as for a descrition of the methods by which the lubricants are made and of their properties.

SUMMARY OF THE INVENTION

We have discovered that the reduced metal oxide catalysts may be used to oligomerize the olefins produced by the thermal cracking of slack waxes. In this way, a relatively cheap refinery product may be readily converted into a high quality synthetic lubricant material.

According to the present invention, olefins produced by the thermal cracking of slack wax are purified to remove heteroatom-containing impurities as well as diolefins and other contaminants and the purified olefins are then oligomerized in the presence of a reduced Group VI metal oxide catalyst to produce a high VI lubricant product. The liquid synthetic lubricants produced in this way typically have kinematic viscosities greater than 2 cS at 100° C., pour points below −15° C. and and VI values greater than 120.

The purification of the cracked wax is preferably carried out by treatment with a scavenging agent such as a deoxygenation catalyst or a molecular sieve, but other techniques may also be used including distillation, sorption and solvent extraction. Treatment with materials of this type remains the preferred method because it readily removes the sulfur and nitrogen impurities which have been associated with catalyst inactivation as well as diolefins which tend to produce undesired high molecular weight polymeric products. Another pretreatment method to remove dienes or acetylenic compounds is by hydrotreatment with catalysts which hydrogenate the diene and acetylene compounds selectively while leaving the alpha-olefins intact.

DETAILED DESCRIPTION

When slack wax is thermally cracked at high temperature, it yields a cracked product containing predominately alpha olefins. When the alpha olefins are recovered from the crackate, purified and oligomerized with the reduced metal oxide catalyst to give an initial oligomer product which is subjected to hydrotreatment to remove residual unsaturation. The final product is a high quality synthetic lubricant characterized by a high viscosity index and low pour point.

FEED

The feed to the process comprises a petroleum slack wax or recycled slack wax which contains between 10 and 50 weight percent oil, as determined by ASTM D-3235 and ASTM D-721. In these feeds of mineral oil origin, the waxes are mostly paraffins of high pour point, comprising straight chain and slightly branched chain paraffins such as methylparaffins.

Petroleum waxes are produced in the refining of petroleum by physical separation from a wax-containing refinery stream, usually by chilling the stream to a temperature at which the wax separates, usually by solvent dewaxing, e.g., MEK/toluene dewaxing or by means of an autorefrigerant process such as propane dewaxing. These waxes have high initial boiling points above about 650° F. (about 345° C.) which render them extremely useful for processing into lubricants which also require an initial boiling point of at least 650° F. (about 345° C.). The presence of lower boiling components is not excluded since they will be removed together with products of similar boiling range produced during the processing during the separation steps which follow the characteristic processing steps. Since these components will, however, load up the process units they are preferably excluded by suitable choice of feed cut point. The end point of wax feeds derived from the solvent dewaxing of neutral oils i.e. distillate fractions produced by the vacuum distillation of long or atmospheric resids will usually be not more than about 1100° F. (about 595° C.) so that they may normally be classified as distillate rather than residual streams but high boiling wax feeds such as petroleum waxes i.e. the waxes separated from bright stock dewaxing, which may typically have an end point of up to about 1300° F. (about 705° C.), may also be employed.

The wax content of the feed is high, generally at least 50, more usually at lest 60 to 80, weight percent with the balance from occluded oil being divided between aromatics and naphthenics. The non-wax content of aromatics, polynaphthenes and highly branched naphthenes will normally not exceed about 40 weight percent of the wax and preferably will not exceed 25 to 30 weight percent. These waxy, highly paraffinic wax stocks usually have low viscosities because of their relatively low content of aromatics and naphthenes although the high content of waxy paraffins gives them melting points and pour points which render them unacceptable as lubricants without further processing.

These slack wax feeds are normally obtained directly from a solvent dewaxing process, e.g. an MEK or propane dewaxing process. The slack wax, which is a solid to semi-solid product, comprising mostly highly waxy paraffins (mostly n- and monomethyl paraffins) together with occluded oil, may be fed directly to the first step of the present processing sequence as described below without the requirement for any initial preparation, for example, by hydrotreating.

The compositions of some typical waxes are given in Table 1 below.

TABLE 1

| Wax Composition - Arab Light Crude | A | B | C | D |
|---|---|---|---|---|
| Paraffins, wt. pct. | 94.2 | 81.8 | 70.5 | 51.4 |
| Mono-naphthenes, wt. pct. | 2.6 | 11.0 | 6.3 | 16.5 |
| Poly-naphthenes, wt. pct. | 2.2 | 3.2 | 7.9 | 9.9 |
| Aromatics, wt. pct. | 1.0 | 4.0 | 15.3 | 22.2 |

A typical slack wax feed has the composition shown in Table 2 below. This slack wax is obtained from the solvent (MEK) dewaxing of a 300 SUS (65 cST) neutral oil obtained from an Arab Light crude subjected to successive catalytic and solvent dewaxing.

TABLE 2

| Slack Wax Properties | | |
|---|---|---|
| API | | 39 |
| Hydrogen, wt. pct. | | 15.14 |
| Sulfur, wt. pct. | | 0.18 |
| Nitrogen, ppmw | | 11 |
| Melting point, °C. (°F.) | | 57 (135) |
| KV at 100° C., cST | | 5.168 |
| PNA, wt. pct: | | |
| Paraffins | | 70.3 |
| Naphthenes | | 13.6 |
| Aromatics | | 16.3 |
| Simulated Distillation: | | |
| % | °C. | (°F.) |
| 5 | 375 | (710) |
| 10 | 413 | (775) |
| 30 | 440 | (825) |
| 50 | 460 | (860) |
| 70 | 482 | (900) |
| 90 | 500 | (932) |
| 95 | 507 | (945) |

Another slack wax suitable for use in the present process has the properties set out in Table 3 below. This wax is prepared by the solvent dewaxing of a 450 SUS(100 cS) neutral raffinate:

TABLE 3

| Slack Wax Properties | |
|---|---|
| Boiling range, °F. (°C.) | 708-1053 (375-567) |
| API | 35.2 |
| Nitrogen, basic, ppmw | 23 |
| Nitrogen, total, ppmw | 28 |
| Sulfur, wt. pct. | 0.115 |
| Hydrogen, wt. pct. | 14.04 |
| Pour point, °F. (°C.) | 120 (50) |
| KV (100° C.) | 7.025 |
| KV (300° F., 150° C.) | 3.227 |
| Oil (D 3235) | 35 |
| Molecular wt. | 539 |
| P/N/A: | |
| Paraffins | — |
| Naphthenes | — |
| Aromatics | 10 |

Other useful slack waxes in the present invention are a medium neutral slack wax with properties shown in Table 4 and a light neutral slack wax with properties shown in Table 5.

TABLE 4

| Medium Neutral Slack Wax | |
|---|---|
| Mol. Wt. (1524) | 453 |
| API gravity: | 37.7 |
| Oil content (D 3235), wt. pct. | 15 |
| Mass Spec. Analysis, wt. pct. | |
| paraffins | 78.5 |
| mononaphthenes | 8.3 |
| polynaphthenes | 4.8 |

TABLE 4-continued

| Medium Neutral Slack Wax | |
|---|---|
| aromatics | 8.4 |

TABLE 5

| Light Neutral Slack Wax | |
|---|---|
| Mol. Wt. | 338 |
| Oil content (D 3235), wt. pct. | 16.3 |
| Mass Spec. Analysis, wt pct. | |
| paraffins | 84.9 |
| mononaphthenes | 4.4 |
| polynaphthenes | 6.9 |
| aromatics | 3.8 |

THERMAL CRACKING

The slack wax feedstock is thermally cracked under conditions suitable for the production of a cracked product which contains a major amount of alpha olefins. Thermal cracking is a well-known process; the present thermal cracking process can be carried out in a variety of process configurations, continuous or batchwise. Typically, the hot wax is feed to the top of a vertical reactor containing quartz chips or other inert material. Typically, the wax is effectively cracked at a temperature between about 950° F. and 1200° F. (510° C. -648° C.) and a pressure between about 50 kPa and 980 kPa at a liquid hourly space velocity (LHSV) between about 0.3 and 20. A preferred cracking temperature is about 590° C. and a preferred pressure is about 103 kPa at a LHSV of about 2. In practice, the wax feed is usually diluted with 1 to 70 percent by volume of an inert gas such as nitrogen or steam. Following thermal cracking the cracking product is fractionally distilled and fractions having carbon number between five and eighteen collected and combined as feedstock for subsequent polymerization to synthetic lubricant.

OLIGOMERIZATION

The oligomerization feedstock mixture typically comprises a $C_5$-$C_{20}$, usually a $C_6$-$C_{16}$ fraction, of olefinic hydrocarbons obtained by the fractionation of the thermal cracking product. A preferred fraction is the $C_6$-$C_{17}$ olefinic hydrocarbon fraction. It has been found that using a narrower cut of olefinic hydrocarbons can improve the lube product properties, but at the cost of reducing lube yields. Decreasing the amount of $C_5$-$C_6$ hydrocarbons in the oligomerization feedstock generally boosts the VI of the lube product, and decreasing the amount of $C_{16}$-$C_{18}$ generally improves lube pour point. However, in the present invention it has been found that using a feedstock comprising $C_5$-$C_{18}$ or $C_6$-$C_{16}$ hydrocarbons provides lube products with surprisingly high VI.

Prior to oligomerization the feedstock is purified to remove heteroatom-containing impurities such as amines, mercaptans, thiophenes and aromatic heterocyclic compounds. Moisture and oxygenated organic compounds such as alcohols, ethers, peroxides and esters which would interfere with the oligomerizations process may be rmoved at the same time. Because many of the contaminants are found in the form of aromatic heterocyclics, solvent extraction may be used to remove many of the harmful materials but an alternative is sorptive separation in which the crude thermal cracking effluent is contacted with a porous inorganic solid such as alumina, silica or silica-alumina under sorption conditions. The preferred porous solids for this purpose are the oxygen-scavenging deoxygenation catalysts and the molecular sieve catalysts. The most effective deoxygenation catalysts are the reduced chromium oxides supported on silica gel although other deoxygenation catalysts containing reduced forms of copper or chromium, such as reduced copper-chromite catalysts or reduced copper oxide on alumina may also be used although they are not so favorable for high product yields. The oligomerization catalyst itself is a highly preferred scavenging agent. These scavenging materials remove the undesirable components in the alpha-olefin stream from the slack wax cracking. Additional treatment of the the slack wax derived olefins by hydrotreatment with a hydrogenation catalyst which is selective for the diolefins and acetylenes without saturation of the mono-olefins may also be used for a further improvement in the purity of the oligomerization feed.

Oligomerization is carried out using a reduced metal oxide catalyst. The metals which are used in these catalysts are the metals of Group VIB of the Periodic Table (IUPAC Table), preferably chromium. Catalysts of this type and their preparation are described in U.S. Pat. Nos. 4,827,064; 4,827,073 and 4,996,384, to which reference is made for a description of the catalysts and their use in oligomerization of alpha-olefins. In the present process, the reduced Group VIB metal oxide catalysts are used in the same way and under the same conditions as described in these patents. The oligomerization proceeds in a way in which a major proportion of the double bonds of the alpha-olefins are not isomerized.

The support material usually has high surface area and large pore volumes with average pore size of 40 to about 350 A. The high surface area is beneficial for supporting large amounts of highly dispersive, active chromium metal centers and to give maximum efficiency of metal usage, resulting in very high activity catalyst. The support should have large average pore openings of at least 40 Å, with an average pore opening of >60 to 300 A preferred. This large pore opening will not impose any diffusional restriction of the reactant and product to and away from the active catalytic metal centers, thus further optimizing the catalyst productivity.

The supported metal oxide catalysts are preferably prepared by impregnating metal salts in water or organic solvents onto the support. Any suitable organic solvent known to the art may be used, for example, ethanol, methanol, or acetic acid. The solid catalyst precursor is then dried and calcined at 200° to 900° C. by air or other oxygen-containing gas. Thereafter the catalyst is reduced by any of several various and well known reducing agents such as, for example, CO or $H_2$. Preferred are CO or $H_2$ or metal alkyl containing compounds.

The reduced metal oxide catalyst is very active for oligomerizing olefins at a temperature range from below room temperature to about 500° C. at a pressure of 0.1 atmosphere to 5000 psi. Oligomers in the higher viscosity range, typically between 725cS and 15,000cS (100° C.) can be prepared when the oligomerization reaction is carried out at a temperature between −20° C. and +90° C. Lower viscosities can be obtained at relatively higher temperatures, typically from 90° to about 250° C. Contact time of both the olefin and the catalyst can vary from one second to 24 hours. The catalyst can be used in a batch type reactor or in a fixed bed, continuous-flow reactor.

The oligomerization may be carried batch-wise or continuously. The process is typically carried out under oligomerization conditions comprising temperature between about 0° C. and 250° C. for a time sufficient to produce the synthetic lubricant. Lower temperatures below about 90° C. usually produce higher viscosity materials, as described in U.S. Pat. No. 5,012,020, to which reference is made for a description of the techniques for making such higher viscosity HVI-PAO type materials which are useful as VI improvers for lube basestocks, both mineral and synthetic. The lower viscosity materials useful as synthetic basestocks can be made at the higher temperatures typically over 90° C., usually 90°-250° C., as described in U.S. Pat. Nos. 4,827,064 and 4,827,073.

Following the oligomerization, the oligomerization product is separated by distillation to remove low boiling components, e.g. boiling below 650° F. and is then hydrogenated to saturate residual olefinic bonds. Hydrogenation can be carried out in the conventional manner; a preferred method is to hydrogenate the product at elevated temperature and pressure with Ni, Pd or Pt on charcoal or other porous solids such as silica, alumina, silica-alumina, kieselguhr, zirconia or titania.

The products of the oligomerization are comparable to those produced by the oligomerization of 1-olefins such as 1-decene. They have a branch ratio of less than 0.19 and viscosity at 100° C. which is typically between 3cS and 10,000cS.

The structure with the branch ratio less than 0.19 is characteristic of the present hydrogenated oligomer products. The branch ratios defined as the ratios of $CH_3$ groups to $CH_2$ groups in the lube oil are calculated from the weight fractions of methyl groups obtained by infrared methods, published in *Analytical Chemistry*, Vol. 25, No. 10, p. 1466 (1953).

$$\text{Branch ratio} = \frac{\text{wt fraction of methyl group}}{1 - (\text{wt fraction of methyl group})}$$

The oligomerization process can be controlled to yield oligomers having weight average molecular weight between oligomers as low as the trimer and oligomers of much higher molecular weight such as oligomers having weight average molecular weights as high as 15,000 and 200,000 and number average molecular weight between 5,000 and 50,000. Measured in carbon numbers, molecular weights range from $C_{30}$ to $C_{10000}$, with a preferred range of $C_{30}$ to $C_{5000}$. Molecular weight distributions, defined as the ratio of weight averaged molecular to number averaged molecular weight, range from 1.00 to 5, with a preferred range of 1.01 to 4.

The product oligomers have a very wide range of viscosities depending on the oligomerization conditions. They exhibit high viscosity indices suitable for high performance lubrication use after undergoing hydrogenation to remove any residual unsaturation. The product oligomers also have atactic molecular structure of mostly uniform head-to-tail connections with some head-to-head type connections in the structure. These low branch ratio oligomers have high viscosity indices at least about 15 to 20 units and typically 30-40 units higher than equivalent oligomers made iwth conventional Lewis acid catalysts, which regularly have higher branch ratios and correspondingly lower viscosity indices. These low branch oligomers also maintain better or comparable pour points than oligomers prepared with conventional oligomerization catalysts.

EXAMPLE 1

Thermal Cracking

A standard stainless steel laboratory reactor filled with about 45 $cm^3$ of 4/16 mesh quartz ("Vycor") chips was used for thermal cracking of a medium neutral slack wax similar to the one described above in Table 4, at atmospheric pressure. Approximately 50 ml/hr of wax was fed from an Isco pump to the top of the reactor along with 30 SCCM nitrogen. The product recovery train consisted of a 120° C. receiver and a 0° C. condenser.

Five six-hour cracking runs were made with the slack wax at a nominal reaction temperature of 590° C. Product yields are listed in Table 6. The liquids collected in the condenser for the five slack wax cracking runs were combined and then fractionated under 0.05-0.1 torr pressure into five fractions whose properties are listed in Table 7.

TABLE 6

| Medium Neutral Slack Wax Cracking Products | |
|---|---|
| Cracking Temp., °C. | 590 |
| $C_{19}$+ conversion, Wt % | 47.1 |
| Wt % yields: | |
| $C_4^-$ | 13.3 |
| $C_5$-$C_6$ | 6.3 |
| $C_7$-$C_{17}$ | 25.2 |
| $C_6$ LAO Purity*, wt % | 78 |
| Wt % selectivities: | |
| $C_1$ | 2.5 |
| $C_2$ | 4.5 |
| $C_2$= | 8.1 |
| $C_3$ | 1.0 |
| $C_3$= | 6.1 |
| $C_4$ | 0.2 |
| $C_4$= | 3.7 |
| $C_4$= = | 1.2 |
| $C_5$'s | 4.7 |
| $C_6$'s | 8.8 |
| $C_7$-$C_{17}$ | 53.5 |

*$C_6$ LAO (linear alpha olefin) purity is the percent normal 1-hexene present in the $C_6$ fraction.

Fractions 1-3, composed of C6-$C_{16}$ olefins were combined and purified over 13×molecular sieve and Deox catalyst (reduced copper chromite) to remove moisture and oxygenates.

TABLE 7

| Properties of Fractions Distilled from Cracked Wax | | | | | |
|---|---|---|---|---|---|
| Fraction | 1 | 2 | 3 | 4 | 5 |
| Fractn. Temp., °C. @ 0.1 mmHg | 25-32 | 32-41 | 42-52 | 55-78 | 70-90 |
| Yields, Wt % of feed | 4.1 | 2.6 | 4.5 | 3.7 | 4.6 |
| Average MW by GC Analysis | 115 | 154 | 178 | 215 | 215 |
| Average MW by bromine No. | 126 | 143 | 166 | 204 | 225 |
| Average Carbon Number | 8.23 | 10.97 | 12.72 | 15.33 | 15.32 |

EXAMPLE 2

Thermal Cracking

Light neutral slack wax containing 16% oil was employed as feedstock for thermal cracking. The light neutral slack wax is lower in molecular weight that the Example 1 medium neutral slack wax (338 versus 453 for the MNSW) and has a higher paraffin content (85 versus 78 wt%) and lower aromatics (3.8 versus 8.4 wt%).

The reactor and thermal cracking conditions were similar to those previously described for Example 1. 50–80 ml/hr of slack wax feed along with 30 SCCM nitrogen was pumped down through a reactor tube filled with 45 cc of quartz chips. Vapor residence times were 5–10 seconds. The temperature in the center of the reactor was about 590° C. The temperature profile dropped off at either end of the reactor.

Product yields from two cracking runs at different flow rates are summarized in columns A and B of Table 8. The products from these runs were distilled to remove $C_{18}$-products. The distillation bottoms (approximately $C_{19}+$) from the lower conversion runs (Run B) were recracked, with yields shown in column C of Table 8. The bottoms from the products of Run C, combined with the bottoms from Run A, were cracked once more (Run D). Run C simulated the recycle operation practiced in commercial wax cracking.

The liquids collected from the slack wax cracking runs were fractionated at 1 atm and under a vacuum of 0.05–0.1 torr.

TABLE 8

Conditions and Product Yields for Thermally Cracked LNSW

| Run | A | B | C | D |
|---|---|---|---|---|
| Feed | LNSW | LNSW | Recycle | Twice Recyc. |
| Cracking Temp. °C. | 590 | 590 | 590 | 590 |
| Feed rate. ml/hr | 50 | 80 | 80 | 80 |
| $C_{19}+$ conversion, wt % | 35 | 28 | 27 | 27 |
| Yields, wt % | | | | |
| $C_1$ to $C_3$ | 9.1 | 6.1 | 5.7 | Not analyzed |
| $C_4$ | 1.9 | 1.2 | 1.3 | |
| $C_5$ | 2.2 | 1.4 | 1.4 | |
| $C_6$ | 3.1 | 2.4 | 2.7 | |
| $C_7$ to $C_{18}$ | 23.5 | 20.7 | 20.1 | |
| Total $C_5$ to $C_8$ | 23.5 | 20.7 | 20.1 | |
| Wt % selectivities: | | | | |
| $C_1$ to $C_3$ | 26.1 | 21.5 | 21.0 | |
| $C_4$ | 5.5 | 4.4 | 4.8 | |
| $C_5$ | 6.3 | 5.0 | 5.2 | |
| $C_6$ | 8.9 | 8.7 | 10.0 | |
| $C_7$ to $C_{18}$ | 52.3 | 60.2 | 59.0 | |
| Total $C_5$ to $C_{18}$ | 67.5 | 73.5 | 74.2 | |

The single-pass conversions of the light neutral slack wax (LNSW) to $C_{18}$-products were 35% and 28% at feed rates of 50 and 80 ml/min, respectively (Runs A and B, Table 8). The lower conversion run gave slightly better selectivity to $C_5$–$C_{18}$ olefins than the high conversion run (74% vs 68%). The once-and twice-recycled wax (Runs C and D) cracked with conversions and selectivities to $C_5$–$C_{18}$ very similar to those of the fresh wax (Run B). This indicates that wax can be recycled for complete conversion with high selectivity to $C_5$–$C_{18}$ products.

The $C_5$to $C_{18}$ products isolated by atmospheric and vacuum distillation are highly olefinic, as indicated by the similar molecular weights calculated by bromine number and by GC analysis. The amount of linear alpha-olefins produced in the lower conversion run (Run B) is slightly higher than that produced in Run A (90% vs 80–85%). The other components are branched, cyclic or aromatic-containing olefins.

EXAMPLE 3

The alpha-olefin mixture produced in Run A of Table 8 was isolated by vacuum distillation and the alpha-olefin fraction with an average crabon length of 10.4 separated (30 g). This fraction was mixed with 15 g of a reduced $CR/SiO_2$ catalyst prepared in the manner desrcibed in U.S. Pat. No. 4,827,064 (Example 1). The catalyst/olefin slurry was heated to 90° C. for about 16 hours. After the catalyst was filtered off, the liquid product was subjected to gas chromatography and found to contain no higher oligomers.

EXAMPLE 4

The same olefin mixture as in Example 3 was treated with 10 g of the same activated $Cr/SiO_2$ catalyst for 16 hours after which the solid catalyst was filtered off. The treated olefin was then mixed with another 10 g of the activated $Cr/SiO_2$ catalyst and heated to 90° C. for 16 hours. The resulting viscous slurry was filtered to remove the catalyst and then distilled at high vacuum to remove light ends. The 650° F. fraction was isolated in 95% yield, with the following properties:

| | |
|---|---|
| Visc., 100° C., cS | 81.69 |
| Visc., 40° C., cS | 701.76 |
| VI | 201 |

The VI of this product is comparable to the VI obtained from the chromium-catalyzed oligomerization of pure 1-decene and is superior to the VI of the products obtained with Lewis acid catalysts such as aluminum trichloride.

We claim:

1. A process for the production of high VI synthetic lubricants, comprising;

oligomerizing a $C_6$–$C_{17}$ olefinic hydrocarbon fraction from the olefinic hydrocarbon product mixture produced by the thermal cracking of slack wax or recycled slack wax with a reduced Group VIB metal oxide catalyst, after removal of heteroatom-containing impurities by treatment with a porous inorganic solid selected from deoxygenation catalysts and molecular sieve catalysts, and separating a product comprising a synthetic olefin oligomer having a branch ratio less than 0.19 and hydrogenating the oligomer product to form a synthetic lubricant having a kinematic viscosity greater than 2 cS at 100° C., pour point less than −15° C. and VI greater than 120.

2. The process of claim 1, wherein said mixture comprises $C_5$–$C_{18}$ hydrocarbons containing at least 60 weight percent linear alpha olefins.

3. The process of claim 1, wherein said mixture comprises $C_6$–$C_{16}$ hydrocarbons having an average carbon number of about 10 to 12.

4. The process of claim 1 wherein said mixture contains at least 75 weight percent linear alpha olefins.

5. The process of claim 1 wherein said catalyst comprises a reduced chromium oxide catalyst.

6. The process of claim 5 wherein the reduced chromium oxide catalyst comprises a catalyst produced by the air oxidation at 400° to 900° C. followed by the reduction in carbon monoxide of chromium on a silica support.

7. The process of claim 1 in which the oligomerization is carried out at a temperature between about 0° C. and 250° C. for a time sufficient to produce said synthetic lubricant.

8. The process of claim 7 wherein said oligomerization temperature is below about 90° C.

9. The process of claim 7 wherein said oligomerization temperature is above about 90° C.

10. The process of claim 1 wherein said slack wax is thermally cracked at a temperature between about 500° C. and 648° C. at a pressure from about 50 kPa to about 980 kPa, then fractionated to provide said product mixture comprising $C_5$-$C_{18}$ olefinic hydrocarbons containing linear alpha olefins.

11. A combined process for the production of high VI synthetic lubricant, comprising:

a) thermally cracking slack wax to produce an olefinic hydrocarbon mixture comprising a major portion of linear alpha olefins;

b) separating said mixture to produce $C_5$-$C_{18}$ hydrocarbon mixture comprising predominantly linear alpha olefins and removing heteroatom-containing impurities by treatment with a porous inorganic solid selected from deoxygenation catalysts and molecular sieve catalysts;

c) oligomerizing said $C_5$-$C_{18}$ mixture in the presence of a reduced chromium catalyst on a porous silica support;

d) recovering at $C_{30}$+ oligomerization product having a branch ratio less than 0.19;

e) hydrogenating the oligomerization product to form a synthetic hydrocarbon lubricant having a kinematic viscosity greater than 2 cS at 100° C. and VI greater than 120.

12. The process of claim 11 wherein the step (b) mixture is separated to vide $C_6$-$C_{16}$ hydrocarbon mixture for the oligomerization.

13. The process of claim 12 wherein said mixture comprises $C_6$-$C_{16}$ hydrocarbons having an average carbon number of about 10 to 12.

14. The process of claim 11 in which the olefin mixture is oligomerized at a temperature between about 0° C. and 250° C.

15. The process of claim 14 in which the olefin mixture is oligomerized at a temperature below about 90° C.

16. The process of claim 14 which the olefin mixture is oligomerized at a temperature above about 90° C.

17. The process of claim 11 wherein said slack wax is thermally cracked at a temperature between about 500° C. and 648° C. at a pressure from about 50 kPa to about 980 kPa.

18. The process of claim 5 wherein the reduced chromium oxide catalyst comprises a catalyst produced by the reduction in carbon monoxide of chromium on a silica support.

19. The process of claim 11 which the wax comprises a wax from the dewaxing of a distillate oil.

20. The process of claim 11 which the oligomer product after hydrogenation a branch ratio of less than 0.19 and a pour point below −15° C.

21. The process of claim 11 in which the oligomer product after hydrogenation a viscosity form 3 cS to about 725 cS at 100° C.

22. The process of claim 11 in which the oligomer product after hydrogenation a number average molecular weight from $C_{30}$ to $C_{10,000}$.

23. The process of claim 11 in which the oligomer product after hydrogenation number average molecular weight from $C_{30}$ to $C_{5,000}$.

24. The process of claim 11 in which the oligomer product after hydrogenation as molecular weight distributions from 1.00 to 5.

* * * * *